US005348468A

United States Patent [19]

Graf et al.

[11] Patent Number: 5,348,468

[45] Date of Patent: Sep. 20, 1994

[54] FIBER BRICK AND BURNER WITH SUCH FIBER BRICK

[75] Inventors: Konrad Graf, Gansbach; Gunter Lasselsberger, Petzenkirchen, both of Austria

[73] Assignee: Chamottewaren-und Thonofenfabrick Aug. Rath Jun. Aktiengesellschaft, Vienna, Austria

[21] Appl. No.: 787,079

[22] Filed: Nov. 4, 1991

[30] Foreign Application Priority Data

Nov. 2, 1990 [AT] Austria ..... 2205/90

[51] Int. Cl.[5] ..... F23M 9/06

[52] U.S. Cl. ..... 431/171; 431/328; 431/353

[58] Field of Search ..... 431/350, 351, 352, 353, 431/186, 159, 354, 328, 329, 326, 171; 60/752, 753, 754; 126/92 R, 92 AC

[56] References Cited

U.S. PATENT DOCUMENTS

| | | | |
|---|---|---|---|
| 3,918,255 | 11/1975 | Holden | 60/753 |
| 4,220,132 | 9/1980 | Streisel | 431/328 |
| 4,580,969 | 4/1986 | Brachet et al. | 431/171 |
| 4,608,012 | 8/1986 | Cooper | 431/328 |
| 4,630,594 | 12/1986 | Ellersick | 126/64 |
| 4,643,667 | 2/1987 | Fleming | 431/7 |
| 4,714,659 | 12/1987 | Lindgren et al. | 428/685 |
| 4,746,287 | 5/1988 | Lannutti | 431/328 |
| 4,752,213 | 6/1988 | Grochowski et al. | 431/328 |

FOREIGN PATENT DOCUMENTS

| | | |
|---|---|---|
| 0294726 | 4/1988 | European Pat. Off. . |
| 0321611 | 6/1989 | European Pat. Off. . |
| 0415008 | 6/1990 | European Pat. Off. . |
| 1979723 | of 1968 | Fed. Rep. of Germany . |
| 7112714 | 3/1970 | Fed. Rep. of Germany . |
| 1930312 | 12/1970 | Fed. Rep. of Germany . |
| 2714835 | 10/1977 | Fed. Rep. of Germany . |
| 2922083 | 4/1980 | Fed. Rep. of Germany . |
| 3005257 | 1/1981 | Fed. Rep. of Germany . |
| 3048044 | 9/1983 | Fed. Rep. of Germany . |
| 3504601 | 8/1985 | Fed. Rep. of Germany . |
| 3833169 | 4/1989 | Fed. Rep. of Germany . |
| 2039829 | 8/1980 | United Kingdom . |

*Primary Examiner*—James C. Yeung
*Attorney, Agent, or Firm*—Joseph W. Berenato, III

[57] ABSTRACT

The invention concerns a fiber burner-brick 5, 13, 24, 34 with a fiber part 7, 15, 25, 35, 46, 54 made of refractory fibers. In order that the said brick be of low eight, insensitive to mechanical and thermal stresses and be characterized by fine and uniform porosity, the fiber part 7, 15, 25, 35, 46, 54 is composed of individual fiber strips 9, 10, 18, 19, 20, 21, 26, 36, 47, 55 each consisting of mutually displaceable fibers intrinsically cohesive and only by themselves, the fiber strips 9, 10, 18, 19, 20, 21, 26, 36, 47, 55 being compressed against each other by a compression system 8, 16, 27, 28, 29, 30, 31, 38, 39, 44, 45, 51.

20 Claims, 4 Drawing Sheets

FIBER BRICK AND BURNER WITH SUCH FIBER BRICK

The invention concerns a fiber brick with a fiber part made of refractory fibers and also a burner with such fiber brick, where "brick" implies an illustratively cylindrical or conical shell acting as a burner port.

Fiber bricks of the most diverse shapes are frequently used in burners. On one hand they serve as baffles for a flame already generated by the burner and in this manner protect neighboring parts from the direct effects of this flame. If they are permeable, i.e. porous, they may also serve in flame generation. In that case they are as a rule mounted at the end of a fuel supply conduit providing the mixture of fuel and air. Thereby the outside is secured, the brick serving as flashback safety.

The terminology of brick port arose because initially they were made from burnt, refractory materials, especially ceramics and therefore were stone-like. Recently such bricks also have been made from refractory, most of the time ceramic, fibers. Illustratively such a fiber brick is described in the European patent document A 0 321 20 611. It consists of several axially consecutive and nesting cylindrical brick segments serving as flame baffles. Such bricks are characterized by low weight and easy handling, further by a short thermal time-constant.

However a substantial drawback of such fiber bricks is that the fibers alone provide no inherent strength. Accordingly the state of the art required to manufacture a fiber part using a binder in order to arrive at an inherently stable structure. Essentially the binder will eliminate the otherwise present elasticity of the fibers, that is, the fiber part is nearly as brittle as the previously known bricks burnt from ceramics. Because of this brittleness, the known fiber brick is sensitive to impacts, pressures and vibrations during shipping, assembly and operation. Moreover, because of the binder, in the case of temperature jumps and large temperature gradients, cracks, further embrittlement and scaling will arise. Also, the inclusion of the binder increases the weight of the fiber brick and hence also its heat capacity.

Burner bricks used for flame generation at the end of a fuel supply conduit are known in many designs (U.S. Pat. No. 4,643,667; European patent document A 0,294,726; German patent document A 38 33 169; U.S. Pat. No. 4,752,213; German patent document 27 14 835; German patent document A 35 04 601; U.S. Pat. Nos. 4,608,012 and 4,746,287: European patent document A 0,415,008). Where fibers are used in the previously known bricks, the problem is in achieving uniform porosity for fuel transmission. This cannot be satisfactorily achieved when using binders, whereby black spots are produced on the brick surface and hence uniform heat distribution is not achieved.

Assuming use of a fiber brick, the object of the invention is to so design a brick that it shall be low-weight, insensitive to mechanical and thermal stresses, and be characterized by fine and uniform porosity.

This problem is solved by the invention in that the fiber part is composed of individual strips of fibers each consisting of relatively displaceable fibers, the cohesion of which is ensured only by themselves, the fiber strips being kept by a compression system in mutual compression. Preferably the fiber strips are prepressed individually or in sets.

On account of compressing a plurality of fiber strips in the manner of the invention, a fiber brick is achieved which is self-supporting in the absence of binders. The mutual displaceability of the fibers assures high elasticity of the fiber part, whereby the fiber brick can withstand high and widely fluctuating temperatures over a long time. Moreover, on account of the elasticity of the fiber part, the fiber brick is insensitive to mechanical stresses during transportation, assembly and operation. The low density of the fiber part ensures low weight with advantages in handling and shipping, and also low heat capacity as well as good insulation. Thereby energy can be conserved, especially during intermittent furnace operation.

Moreover, the combination of fiber strips and compression system of the invention is extraordinarily flexible with respect to aligning the fibers and adjusting the porosity. Tests have shown it is possible to produce very fine porosity which is unusually uniform across the surface, and this shall be a particular advantage when a broad flame must be generated on the outer surface of the fiber brick.

In the sense of the invention, the concept of compression system is quite general. In the simplest case a suitable clearance in the wall of the fire space of a furnace will suffice, the fiber strips then being of such sizes that following their insertion, they shall be mutually compressed. Obviously the compression system also may be combined with an adjustment device in order to adjust or fine-control thereby the porosity of the fiber part also during operation.

A substantial advantage of the design of the invention for a fiber brick is that the cross-sections of the fiber strips always can be so dimensioned that the gross density of the fiber part shall be essentially constant across its cross-section. This is especially advantageous if air or fuel is flowing through the fiber brick.

In the invention, the fiber part assumes the shape of an illustratively cylindrical fiber shell enclosing a duct. In that case the fiber shell preferably consists of a plurality of peripherally adjacent but otherwise axially extending fiber strips which at least in part preferably comprise a cross-section tapering toward the inside of the fiber shell. In particular trapezoidal or triangular cross-sections are suitable cross-sectional shapes. Fiber strips of rectangular cross-section may alternate in the peripheral direction of the fiber shell with fiber strips of which the cross-section tapers toward the duct.

As an alternative to a cylindrical fiber shell, this fiber shell also may be shaped in such a way that the duct tapers toward one end. In this case the fiber strips preferably are partly shortened toward that end in order to account for the change in cross-section. Alteratively or in combination therewith, the fiber strips also may be designed in such a way that they cross-sectionally taper conically at least in part toward the more narrow opening.

When the fiber strips are consolidated into a fiber shell, the compression system can consist illustratively and in simple manner of an outer, metal casing with the fiber shell resting pre-stressed against the inside surface of the said casing. This may be a metal sleeve if the fiber brick is installed in such a way that no throughflow takes place. However the outer casing also may be provided with a plurality of apertures and illustratively it may be in the form of a wire mesh or a rib-mesh metal sleeve. Thereby radial flow is possible through the fiber shell, for instance in order to transmit air through the fiber shell into the duct or to generate a big flame on the outside surface of the fiber shell. In addition, the outer casing may be enclosed by a fiber mat made of refractory fibers.

Moreover a cylindrical or conical fiber shell may be made in that the fiber strips are annular fiber panes, i.e. washers, consecutively mounted in the direction of the duct. If such fiber panes or washers are stamped out of the raw product present as a mat, perforce their fibers will extend in radial planes, and thereby the fiber shell will evince a brush-like structure at the inner and outer surfaces. The compression system in this case may consist of terminal washers and of radially extending tension bolts connecting them.

The invention further provides that the fibers in the fiber strips predominantly extend in radial planes. Thereby the individual fiber strips are correspondingly cut out of the raw product, ie the fiber mat, and are suitably positioned. In such fiber mats, the individual fibers extend predominantly in planes parallel to the surfaces, the fibers inside these planes being arrayed randomly. The array of the invention of the fiber strips results in a brush-like surface structure both on the inside and on the outside of the fiber shell. Fiber detachment is prevented thereby.

In the case a flame must be generated on the outside of the fiber shell, the invention provides that the duct be closed at one end, namely the free end, in order to constrain the fuel to flow through the fiber shell and to issue only at its outside.

Not only fiber parts shaped like shells or jackets are suitable for the above applications, but also those parts in the form of fiber plates consisting of pluralities of fiber strips. In that event the fiber strips are mounted next to each other and are held at the sides for instance by housing walls forming the compression system keeping the fiber strips mutually compressed. The fiber plate may assume any arbitrary peripheral shape, for instance rectangular, oval, round or the like. In its simplest form it is planar. However it may also be conical, i.e. like a funnel. In all cases the fiber strips predominantly are mounted in such a way that the fibers preferably extend in planes transverse to the plate plane, that is, in the direction of flow crossing. As a result a brush-like structure preventing fiber detachment is achieved in this case too on one hand at the incident-flow surface and on the other hand at the flame-carrying surface.

A burner equipped with the above described fiber brick also is an object of the invention. In this invention, the fiber shell is installed into a furnace clearance forming the compression system. As an alternative, the fiber shell also can be installed in an air duct a distance away from this duct's walls. When the flame is generated in the fiber-shell duct, air is sucked through the fiber shell, especially if it is conically tapering, resulting both in clean combustion and in cooling the molded fiber part and hence preserving its life. If there is absence of partial vacuum in the fiber shell, a blower may be used forcing the air from the outside through the fiber shell.

In the invention, the burner may be designed in such a way that the fiber part is mounted at one end of the fuel supply conduit, whereby the flame shall be generated only at the outside of the fiber part. The extraordinarily uniform porosity of such a fiber part ensures low acoustic emission, very even radiation distribution and clean combustion with low proportions of noxious parts. The supply conduit moreover may be divided into a fuel conduit and an air conduit, the fuel conduit issuing centrally at the outside of the fiber part, whereas the air conduit is sealed by the fiber part. In this case only the combustion air flows through the fiber part.

The invention is elucidated by embodiment modes shown in the drawing.

Figure 2:
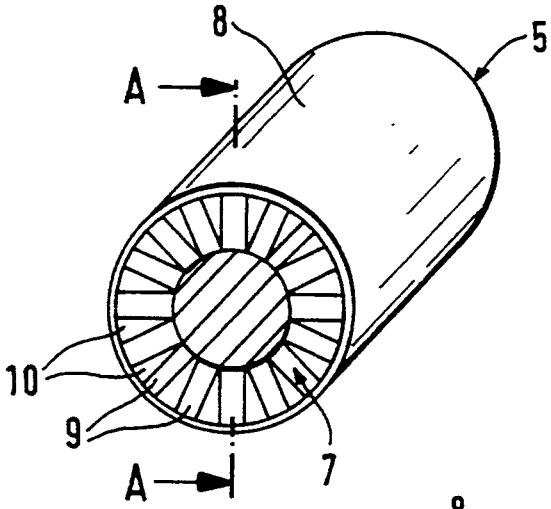
FIG. 2 is a perspective of the fiber burner-brick of the invention.
Figure 3:
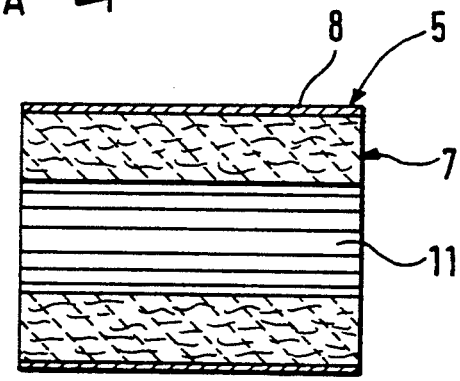
Figure 4:
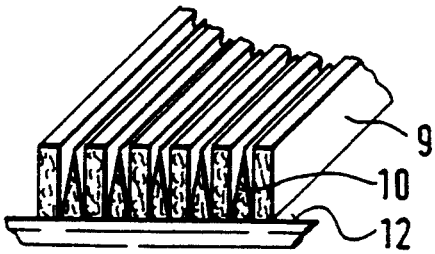
Figure 5:
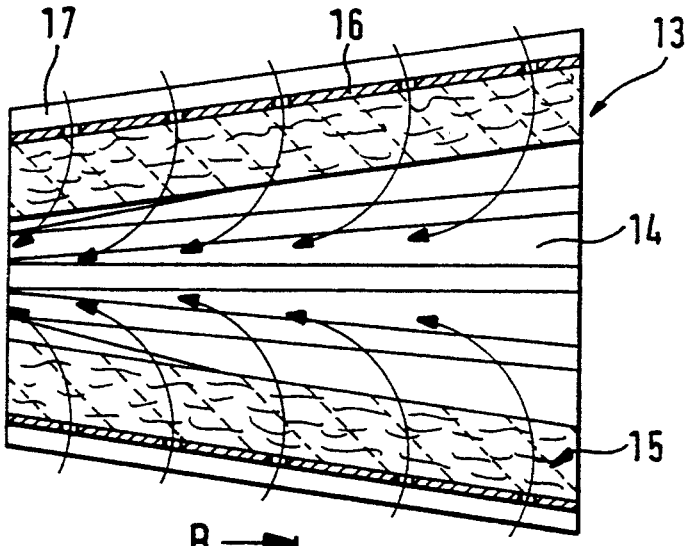
Figure 6:
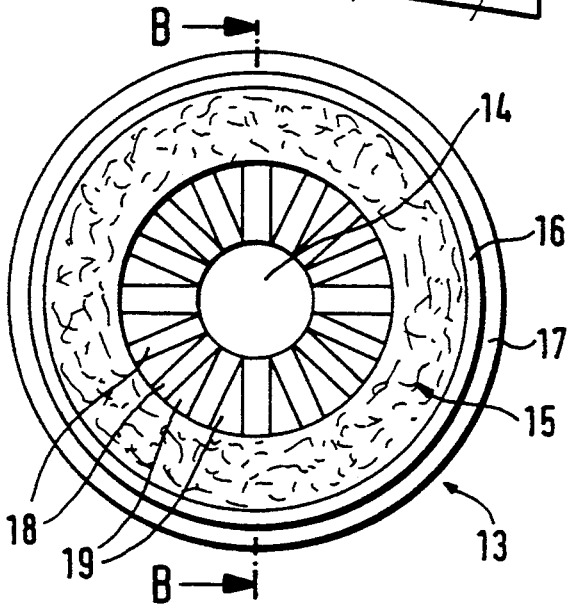
Figure 7:
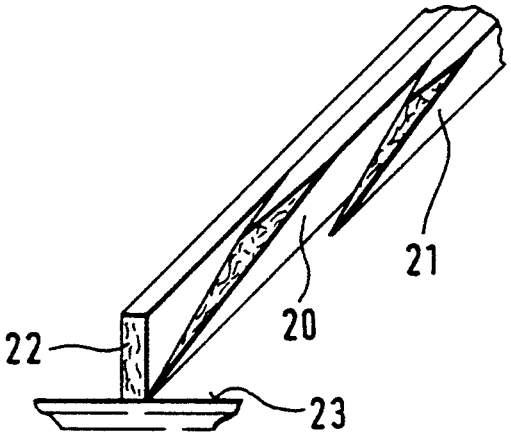
Figure 8:
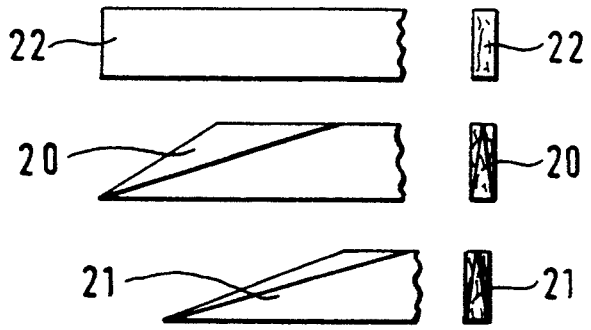
Figure 9:
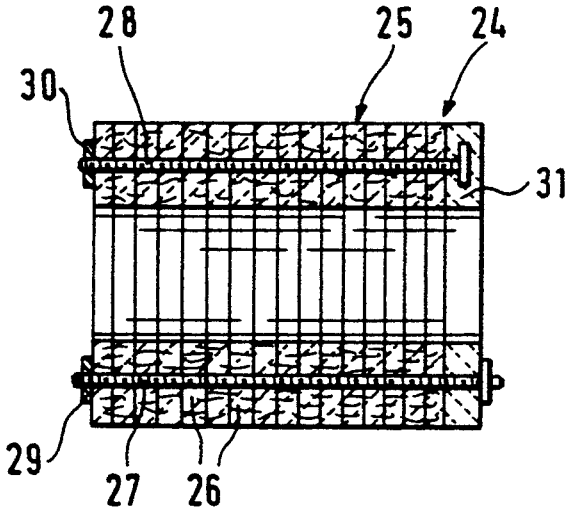
Figure 10:
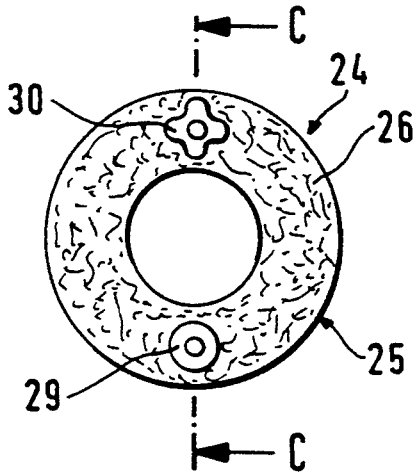
Figure 11:
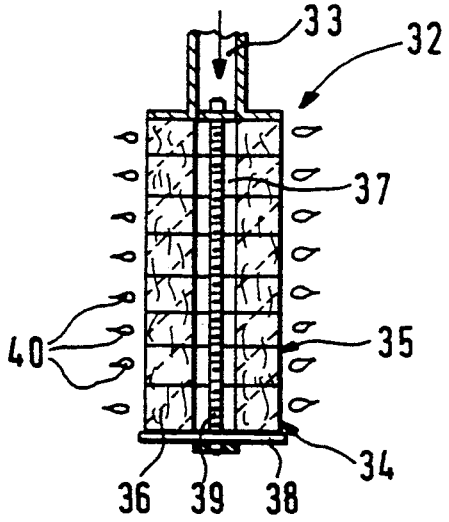
Figure 12:
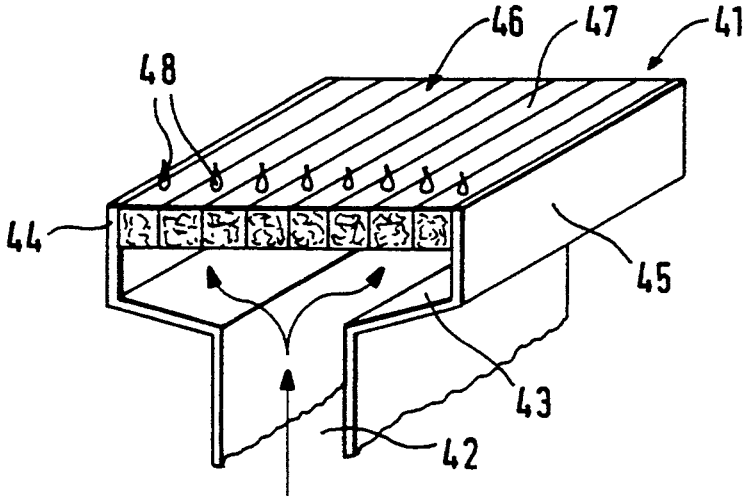
Figure 13:
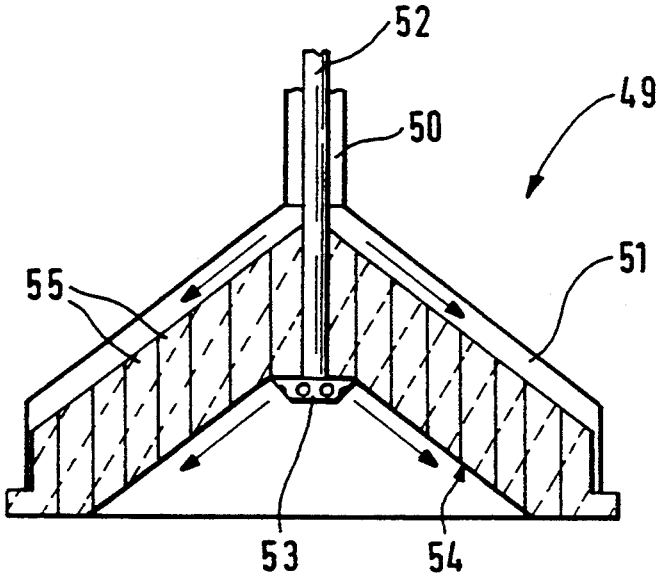

FIG. 3 is an axial section of the fiber burner-brick in the plane A—A of FIG. 2, FIG. 4 is the perspective of a geometric development of part of a fiber strip used to make the fiber burner-brick of FIGS. 2 and 3, FIG. 5 is an axial section of a conical fiber burner-brick in the plane B—B of FIG. 6, FIG. 6 is a front view of the fiber burner-brick of FIG. 5, FIG. 7 is a partial perspective of the fiber strip of the fiber burner-brick of FIGS. 5 and 6, FIG. 8 shows three designs of fiber strips for the fiber burner-brick of FIGS. 5 and 6, in side and front views, FIG. 9 is an axial section of a cylindrical fiber burner-brick in the plane C—C of FIG. 10, FIG. 10 is a front view of the fiber burner-brick of FIG. 9, FIG. 11 is an axial section of a burner with a cylindrical fiber burner-brick, FIG. 12 is an axial section and perspective of a burner with planar fiber plate, and FIG. 13 is an axial section of a burner with a triangular fiber plate.

Figure 1:
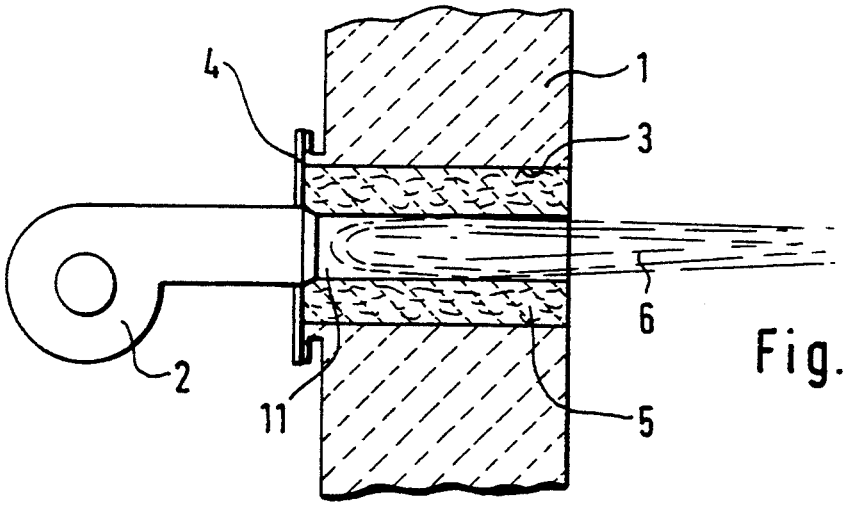
FIG. 1 is a vertical section of the combustion chamber of a furnace.

FIG. 1 shows part of the wall 1 of a combustion chamber of a furnace at the outside of which is mounted a gas burner 2. The combustion-chamber wall 1 comprises a cylindrical clearance 3 from one side to the other and bounded on the outside by a flange 4 from which the gas burner 2 is suspended. A cylindrical fiber burner-brick 5 is inserted into the clearance 3. The fiber brick 5 serves to guide a flame 6 generated by the gas burner 2 and insulates this flame 6 from the combustion-chamber wall 1.

FIGS. 2 and 3 show details of the fiber brick 5 of FIG. 1. The fiber brick 5 consists of a fiber shell 7 and of an enclosing metal outer casing 8, for instance rib mesh.

As shown especially clearly by FIG. 2, the fiber shell 7 is composed of peripherally adjacent fiber strips alternatingly of rectangular cross-section and illustratively denoted by 9 and of triangular cross-sections illustratively denoted by 10, the latter tapering toward the guide duct 11 enclosed by the fiber shell 7. The fiber strips 9, 10 extend over the entire axial length of the fiber shell 7. They are dimensioned in such a way that they abut in pre-pressed manner against the inside of the outer casing 8. Thereby the fiber strips 9, 10 also press against each other.

FIG. 4 shows part of the fiber shell 7 with the rectangular fiber strips 9 and the triangular fiber strips 10 horizontally laid out, ie geometrically developed on a base 12. The Figure makes it plain that the individual fibers extend in planes which are essentially parallel to those wherein the fiber strips 9, 10 are adjacent following assembly of the fiber shell 7. Thereby a brush-like structure with fibers projecting perpendicularly from the surfaces is achieved both on the inside and on the outside of the fiber shell 7.

As regards the embodiment mode of a fiber brick 13 shown in FIGS. 5 and 6, the duct 14 enclosed by said brick is conical, its cross-section tapering toward the end of the duct 14. In matching manner, the fiber shell 15 of the fiber brick 13 also is conical and is enclosed by a conical, outer casing 16 comprising an opening which is not shown herein in further detail.

The fiber brick 13 is inserted in an air duct 17 parallel to and spaced from the outer casing 16 and also conical and sealed at the tapered end. In operation, a flame is generated from the wider end in the duct 14, and on account of the nozzle effect of the fiber shell 15, this flame generates a partial vacuum, whereby air is sucked from the outside through the air duct 17 through the flow apertures in the outer casing 16 and through the fiber shell 15 into the duct 14. As a result both combustion is improved and the fiber shell 15 is constantly cooled.

In this embodiment mode too, the fiber shell 15 is composed alternatingly of cross-sectionally rectangular fiber strips illustrative denoted by 18 and of cross-sectionally triangular fiber strips illustratively denoted by 19. In order to achieve cross-sectionally uniform gross density in this embodiment of the fiber brick 13, the fiber strips 18, 19 are shortened at regular intervals toward the tapering end of the duct 11 on one hand, and on the other, they are shaped like wedges.

FIGS. 7 and 8 show fiber strips 20 cut into wedges at their ends and additional fiber strips 21 and a rectangular fiber strips 22 that are placed against one another on a planar base shown in FIG. 7 and that are shown individually both frontally and from the side in FIG. 8. The particular desired cone angle of the fiber brick 13 can be achieved by means of such fiber strips 20, 21, 22.

FIGS. 9 and 10 again show a cylindrical fiber brick 24. As shown especially clearly by FIG. 9, this fiber brick 24 comprises a fiber shell 25 composed of annular fiber panes, ie washers, illustratively denoted by 26 and arrayed axially behind one another. The fiber washers 26 are stamped out of a fiber mat of suitable thickness, the fibers preferably extending in planes parallel to the fiber-mat surface. Accordingly the fibers of the fiber brick 24 extend mainly in radial planes, whereby again a brush-like structure is achieved at the inside and outside surfaces of the fiber shell 25.

In order that the fiber brick 24 be intrinsically mechanically strong and so that the individual fiber washers 26 be kept together, a compression system is provided which comprises two axial tension bolts 27, 28 of which the ends rest on one side on circular or cross-shaped support panes 29, 30 resp. and at the other end on a rigid support ring 31. By means of these tension bolts 27, 28, it is possible in simple manner to adjust the mutual compression of the fiber washers 26 and thereby also the porosity of the fiber shell 25, even subsequently.

FIG. 11 is a partial view of a burner 32. It comprises a fuel-mixture supply conduit 33 terminated downward by a cylindrical fiber burner-brick 34. The fiber brick 34 comprises a fiber shell 35 consisting of fiber washers illustratively denoted by 36 and consecutively arrayed in the axial direction. The fiber shell 35 encloses a guide duct 37 axially joining the supply conduit 33 and sealed at its end by a clamping plate 38. A tension bolt 39 connected to the clamping plate 38 passes through the guide duct 37 and is screwed in a manner not shown in further detail in the vicinity of the mouth of the guide duct 37 into a fastener and allows adjusting the mutual compression of the fiber washers 36 and thereby the porosity of the fiber shell 35.

A flame 40 is generated by this fiber brick 34 on the outer peripheral surface of the fiber shell 35. For this purpose a mixture of fuel and air is introduced through the supply duct 33 into the guide duct 37. Because of the porosity of the fiber shell 35, the fuel-air mixture flows through it and issues at the outer peripheral surface where it is ignited or ignites by itself.

FIG. 12 shows a further burner 41 with a rectangular supply duct 42 for a fuel-air mixture. The supply duct 42 comprises a flaring part 43 with mutually parallel lateral clamping flanges 44, 45.

A fiber plate 46 consisting of a plurality of adjoiningly mounted, cross-sectionally rectangular fiber strips 47 is clamped between the clamping flanges 44, 45. The fiber strips 47 are dimensioned in such a way that they are compressed by one another and are pre-pressed against the clamping flanges 44, 45. If so desired, one of the clamping flanges 44, 45 may be designed to be displaceably adjustable in the plane of the fiber plate 46 in order to change the pre-pressing and hence the porosity of the fiber plate 46. The fiber strips 47 are mounted in such a way that the fibers extend in planes lying in the direction of flow. In this manner a brush-like structure is created on the free surfaces of the fiber mats 46.

When operating the burner 41, a fuel-air mixture is made to pass through the supply conduit 42 and through the fiber plate 46. Thereupon the mixture issues at the upper surface of the fiber plate 46 where it shall be ignited and a large flame 48 shall be created.

FIG. 13 shows another burner 49. This burner comprises an air-supply conduit 50 which opens downward like a funnel 51. The air supply conduit 50 is coaxially crossed by fuel conduit 52 issuing at the down side into a manifold 53. A funnel-shaped fiber plate 54 is clamped in the funnel-like widening 51. The conical top side of said fiber plate is spaced from the wall of the widening 51. The fuel 52 passes through the fiber plate 54 and the apertures of the manifold 53 are directed toward the bottom side of the fiber plate 54.

The fiber plate 54 consists of a plurality of fiber strips illustratively denoted by 55 and with their opposite contact surfaces extending axially. This is also the case for the planes in which the fibers of the individual fiber strips extend, whereby a brush-like structure is achieved at the top and bottom sides of the fiber plate 54.

When the combustion chamber 49 is operating, pure air is fed through the air supply conduit 50 and the widening 51 to the fiber plate 54. This air passes through the fiber plate 54 and then issues in finely distributed form from the bottom side. Simultaneously the fuel is spread by means of the fuel conduit 52 and the manifold 53 across the bottom side of the fiber plate 54 and mixes in this zone with the air issuing from the fiber plate 54 and in this manner a mixture is obtained which can be ignited.

We claim:

1. A fiber burner-brick, comprising:

a) a plurality of juxtaposed fiber strips forming an axially extending apertured fiber part, each strip formed from relatively displaceable intrinsically cohesive refractory fibers; and, b) an axially extending compression system operably associated with said fiber part and operably engaged with each of said strips for compressing said strips against each other so that the gross density of said strips over the cross-section of said fiber part is essentially constant.

2. The burner-brick of claim 1, wherein:

a) said strips are pre-pressed.

3. The burner-brick of claim 1, further comprising:

a) a fiber shell; and b) said strips are disposed adjacent said shell so that the apertures therethrough define a duct.

4. The burner-brick of claim 3, wherein:

a) said strip extend axially within said shell and are peripherally disposed thereabout.

5. The burner-brick of claim 4, wherein:

a) at least some of said strips cross-sectionally taper toward said shell.

6. The burner-brick of claim 5, wherein:

a) the cross-section of said strips is one of a trapezoid and a triangle.

7. The burner-brick of claim 5, wherein:

a) a cross-sectionally rectangular strip extends between the cross-sectionally tapering strips.

8. The burner-brick of claim 7, wherein:

a) said rectangular strips extend axially within said shell and are peripherally disposed thereabout.

9. The burner-brick of claim 3, wherein:

a) said shell is frustoconical; and b) at least some of said strips are shortened relative to a first end of said shell.

10. The burner-brick of claim 3, wherein:

a) said shell is frustoconical;

b) said duct is correspondingly frustoconical; and c) said strips taper in wedge-shape toward a first end of said shell.

11. The burner-brick of claim 3, wherein said compression system includes:

a) an outer casing; and, b) said shell is pre-pressed against an inside surface of said casing.

12. The burner-brick of claim 11, wherein:

a) a plurality of radially aligned apertures are disposed about said casing.

13. The burner-brick of claim 11, further comprising:

a) a fiber mat comprised of refractory fibers; and, b) said mat is disposed about an outside surface of said casing.

14. The burner-brick of claim 3, wherein:

a) each of said strips is a fiber washer; and b) said washers are coaxially disposed.

15. The burner-brick of claim 14, wherein said compression system includes:

a) at least first and second oppositely disposed planar fittings between which said washers extend; and, b) at least a first tension bolt extends between said fittings.

16. The burner-brick of claim 3, wherein:

a) the fibers of said strips extend radially.

17. The burner-brick of claim 3, wherein:

a) a first end of said duct is sealed.

18. The burner-brick of claim 3, wherein said compression system includes:

a) a furnace having a clearance therethrough; and, b) said shell is inserted into said clearance for therewith causing compression of said strips.

19. The burner-brick of claim 3, further comprising:

a) a fuel supply conduit; and, b) said fiber part is mounted to an end of said fuel supply conduit.

20. The burner-brick of claim 19, wherein:

a) said fuel supply conduit includes a fuel conduit and an air conduit; and, b) said fiber part is mounted to said air conduit, and said fuel conduit issues centrally along an outside surface of said fiber part.

* * * * *